US007637264B1

(12) United States Patent
Roberson

(10) Patent No.: US 7,637,264 B1
(45) Date of Patent: Dec. 29, 2009

(54) HAIRSTYLING DEVICE

(75) Inventor: Annie M. Roberson, P.O. Box 762, Quitman, MS (US) 35399

(73) Assignee: Annie M. Roberson, Stonewall, MS (US)

( * ) Notice: Subject to any disclaimer, the term of this patent is extended or adjusted under 35 U.S.C. 154(b) by 395 days.

(21) Appl. No.: 11/607,938

(22) Filed: Dec. 4, 2006

(51) Int. Cl.
*A45D 7/02* (2006.01)

(52) U.S. Cl. ..... 132/212

(58) Field of Classification Search ..... 132/271, 132/201, 212, 213, 123, 262, 53, 56; 26/51; 28/278, 279, 220, 113, 114; 87/55, 38; 434/94; 57/28; 139/451; 623/15.11; 19/115 R; 15/201, 15/203

See application file for complete search history.

(56) References Cited

U.S. PATENT DOCUMENTS 4,954,720 A 9/1990 Jensen
5,361,468 A * 11/1994 Ho ..... 28/279
5,921,253 A 7/1999 Jeong
6,222,899 B1 4/2001 Pryor et al.
6,595,219 B2 * 7/2003 Anderson ..... 132/123
7,389,779 B2 * 6/2008 Chan ..... 132/136
2007/0272263 A1 * 11/2007 Gold ..... 132/201

* cited by examiner

*Primary Examiner*—Robyn Doan
*Assistant Examiner*—Brianne E O'Neill

(57) ABSTRACT

A hairstyling device includes a pair of telescopically adjustable legs that have linear female portions and inverted T-shaped male portions, including vertically registered top regions slidably fitted into the female portions and horizontally registered bottom regions coupled to the top regions that engage a support surface. A casing is coupled to the legs and has a linear exit slot extending therealong. A stabilizing clamp is pivotally connected to an exterior of the casing and is provided with a fastening clip. Spindles are seated within the casing. A mechanism is included for vertically raising a group of the spindles out from the casing. A mechanism is included for horizontally registering the group of spindles with the exit slot such that remaining spindles are prohibited from exiting through the exit slot, thereby automatically adjusting a thickness of the hair clumps that are separated by the selected spindles.

18 Claims, 4 Drawing Sheets

HAIRSTYLING DEVICE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to hair styling devices and, more particularly, to a hair styling device for assisting a user to separate clumps of hair for creating braids.

2. Prior Art

Hair braiding is one of the oldest forms of enhancing a person's physical appearance. More than simply pulling the hair back to reveal the attractive features of the face; braiding adds a decorative pattern that adds to the individual's natural beauty. Usually, hair is manually braided by a person other than the one who wants to obtain the hair style of dreadlocks. This braiding work takes extremely long time and costs too much. Also, the quality of such manually-braided hair style depends on the worker's skill totally, so that it may not be uniform. Several persons, especially among the African American population, prefer having a plurality of smaller braids that effectively cover the entirety of their head.

Some persons actually grow their hair to a sufficient length to have a professional hair stylist braid the strands into such smaller braids across their entire head. This is a rather time consuming process since the person must first grow their hair to a sufficient length, and subsequently spends a lot time having their hair braided. Due to this, it has become common practice to purchase pre-braided wigs or strands of hair that can be worn over or attached to existing strands of hair, respectively.

Today, there are a number of known braiding machines. One prior art example shows a hand-operated hair braiding machine wherein three passages through which hair is drawn are alternately rotated to braid the hair. Each of the passages is disposed in an elliptical gear. The combination of a pinion gear member with its axle disposed in a slot, and a toggling pawl, combine to effect the braiding motion of the elliptical gears. Unfortunately, such a braiding machine is limited to forming one braid at a time, thus still requiring a significant amount of time to form enough braids for covering the entirety of one's scalp.

Accordingly, a need remains for a hairstyling device in order to overcome the above-noted shortcomings. The present invention satisfies such a need by providing a device that is convenient and easy to use, provides considerable time-, cost- and space-savings, is durable in design, and is versatile in it uses. Such a device automatically measures and separates bunches of synthetic hair for individual braids in various styles. With the hairstyling device, hairdressers are more efficient and can thus conveniently earn more money. Such a device also allows a stylist to use the entirety of a package of synthetic hair, which conveniently prevents unnecessary wastage, saving the salon owner considerable supply costs.

BRIEF SUMMARY OF THE INVENTION

In view of the foregoing background, it is therefore an object of the present invention to provide a hairstyling device. These and other objects, features, and advantages of the invention are provided by a hairstyling device for assisting a user to separate clumps of hair for creating braids.

The hairstyling device includes a pair of telescopically adjustable legs seated on a support surface. Each of the telescopically adjustable legs includes a linear female portion and an inverted T-shaped male portion that has a vertically registered top region slidable into the female portion. Such a male portion further has a horizontally registered bottom region directly coupled to the top region that directly engages a support surface.

A casing is directly coupled to the legs and is supported at an elevated height. Such a casing has a linear exit slot extending along a longitudinal length thereof. A stabilizing clamp is pivotally connected to an exterior of the casing. Such a stabilizing clamp extends along an entire longitudinal length of the casing and is provided with a fastening clip oppositely seated from a pivot axis thereof. The stabilizing clamp and the slot have corresponding longitudinal lengths extending parallel to each other.

A plurality of spindles are seated within the casing. Such spindles may be directly coupled to the second guide track. The spindles preferably include first, second, third and fourth spindle rows registered parallel to each other and disposed within the casing. Each of the spindle rows has a unique distance defined between adjacent spindles thereof such that each of the spindle rows effectively separate unique sized clumps of hair as the user rotates the rotary knob.

A mechanism is included for selectively raising a selected group of the spindles vertically upward and out from the casing. The spindle raising mechanism preferably includes a lever confronting an outer side of the casing that is rotatable between vertical and horizontal positions. A first drive gear is housed within the casing and is directly connected to the lever. Such a drive gear has a toothed outer periphery. A first linear guide track has a corrugated longitudinal surface directly engaged with the first drive gear. Such a first guide track contiguously lays along an interior wall of the casing and is oriented parallel to a vertical plane wherein the first guide track is vertically displaced between raised and lowered positions when the first drive gear is rotated during operating conditions.

A mechanism is included for horizontally registering the selected group of spindles with the exit slot such that remaining ones of the spindles are effectively prohibited from exiting through the exit slot, thereby automatically adjusting a thickness of the hair clumps that are separated by the selected spindles. The spindle registering mechanism may include a platform that is directly mated to the first guide track. A second linear guide track is registered orthogonal to the first linear track and is housed within the casing. A second drive gear is directly inter-locked with the second guide track. Such a second drive gear has a shaft directly connected thereto that terminates to an exterior of the casing. A rotary knob is directly connected to the shaft such that the second drive gear can effectively be linearly displaced along a horizontal path of the second guide track, thereby horizontally aligning the selected spindles beneath the slot. The first and second drive gears are preferably independently and simultaneously operable. Such first and second drive gears have corresponding fulcrum axes registered parallel to each other.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
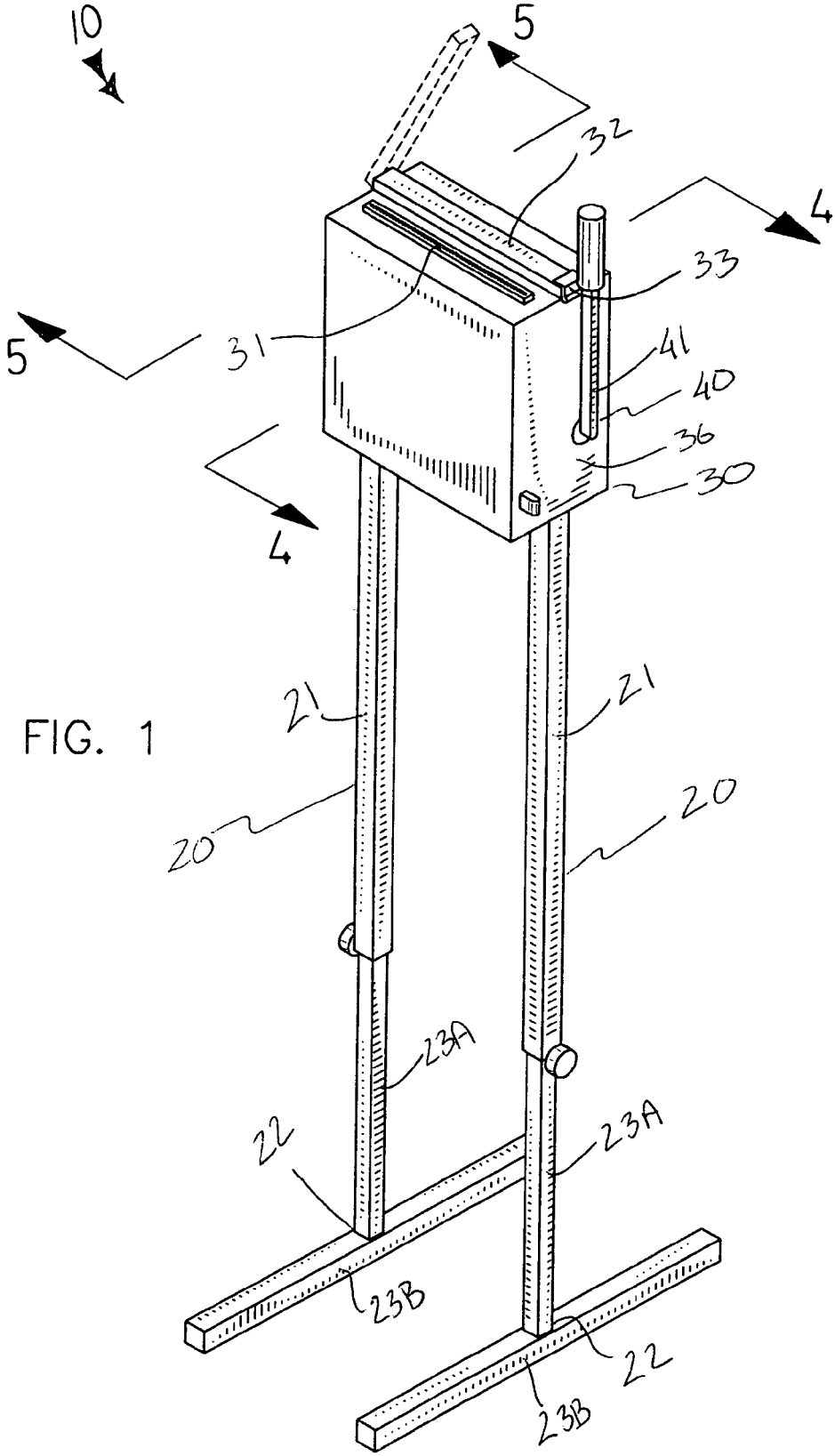
FIG. 1 is a perspective view showing a hairstyling device, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1-5 by the reference numeral 10 and is intended to provide a hairstyling device. It should be understood that the device 10 may be used to braid and weave many different types of stranded materials and should not be limited in use to only weaving strands of synthetic hair.

Figure 2:
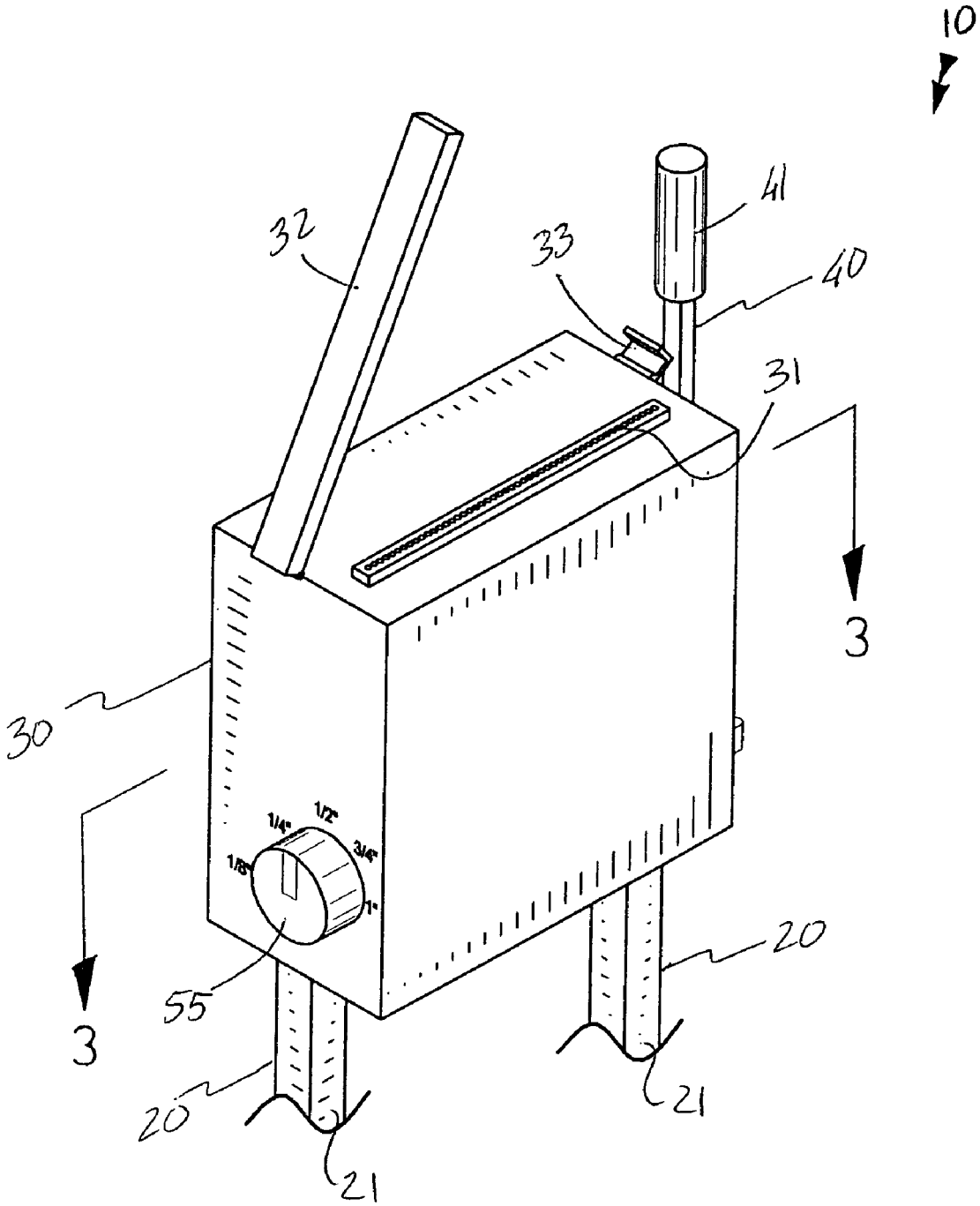
FIG. 2 is an enlarged perspective view of the casing shown in FIG. 1.

Referring initially to FIGS. 1 and 2, the device 10 includes a pair of telescopically adjustable legs 20 seated on a support surface. The telescopic nature of the legs 20 is vital for allowing persons of varying stature to comfortable use the device 10 by quickly and easily adjusting same to a desired height. Each of the telescopically adjustable legs 20 includes a linear female portion 21 and an inverted T-shaped male portion 22 that has a vertically registered top region 23A slidable into the female portion 21. Such a male portion 22 further has a horizontally registered bottom region 23B directly coupled, without the use of intervening elements, to the top region 23A that directly engages a support surface.

Referring to FIGS. 1, 2, 3, 4 and 5, a casing 30 is directly coupled, without the use of intervening elements, to the legs 20 and is supported at an elevated height. Such a casing 30 has a linear exit slot 31 extending along a longitudinal length thereof. A stabilizing clamp 32 is pivotally connected to an exterior of the casing 30. Such a stabilizing clamp 32 extends along an entire longitudinal length of the casing 30 and is provided with a fastening clip 33 oppositely seated from a pivot axis thereof, as is best shown in FIGS. 1 and 2. The stabilizing clamp 32 and the slot 31 have corresponding longitudinal lengths extending parallel to each other.

Figure 3:
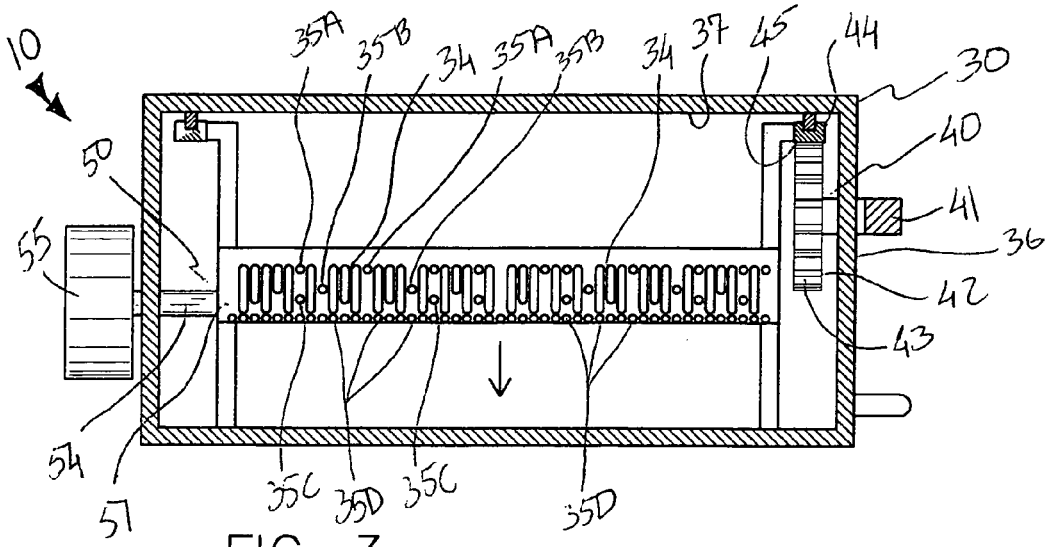
FIG. 3 is a cross-sectional view of the casing shown in FIG. 2, taken along line 3-3.
Figure 4:
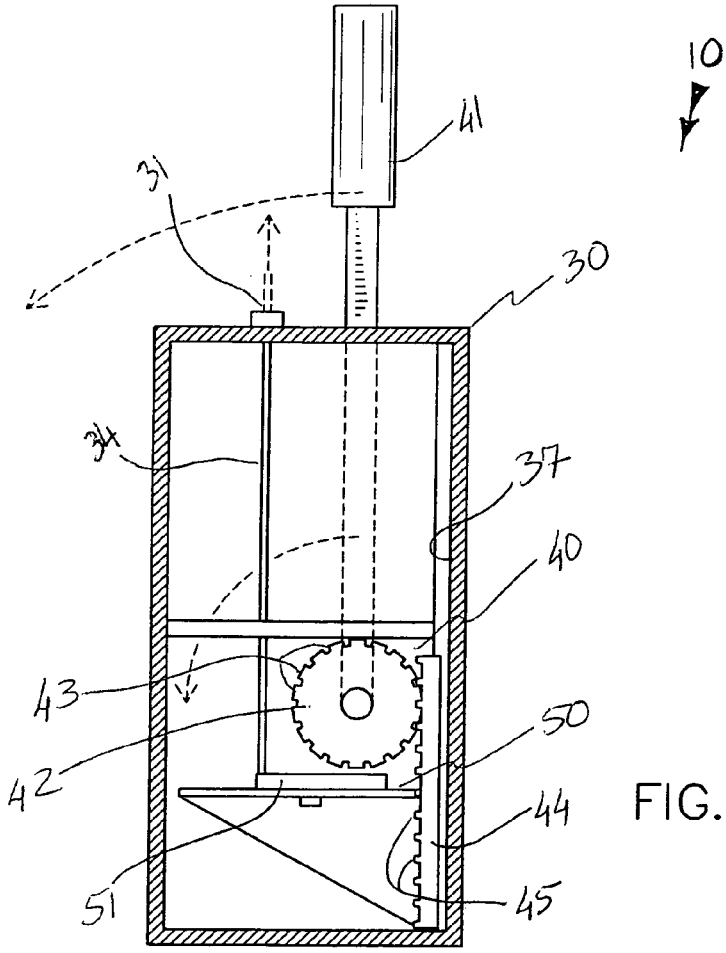
FIG. 4 is a cross-sectional view of the casing shown in FIG. 1, taken along line 4-4.
Figure 5:
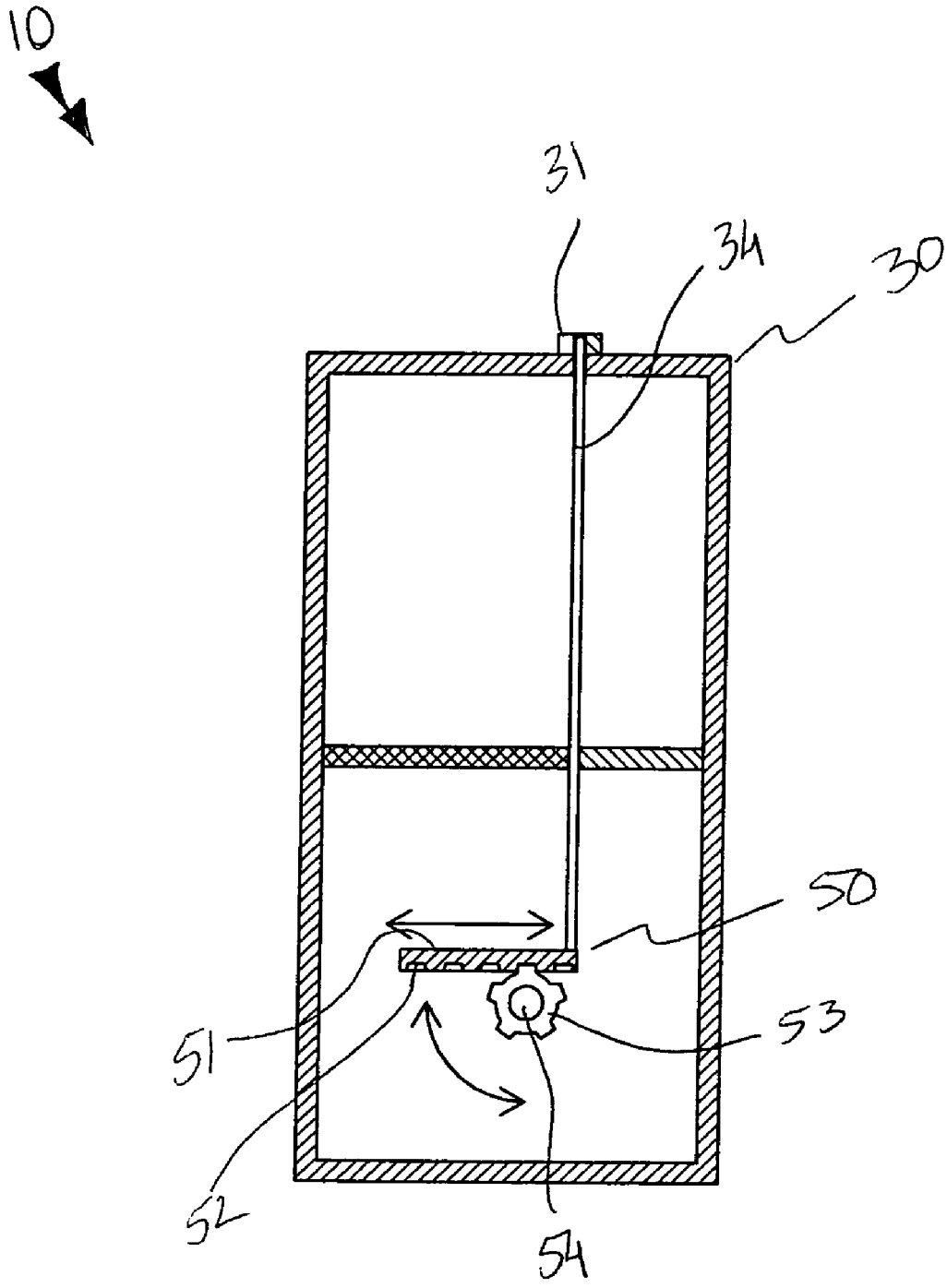
FIG. 5 is a cross-sectional view of the casing shown in FIG. 1, taken along line 5-5.

Referring to FIGS. 3, 4 and 5, a plurality of spindles 34 are seated within the casing 30. Such spindles 34 are directly coupled, without the use of intervening elements, to the second guide track 52 (described herein below). The spindles 34 include first 35A, second 35B, third 35C and fourth 35D spindle rows registered parallel to each other and disposed within the casing 30. Each of the spindle rows 35 has a unique distance defined between adjacent spindles 34 thereof, which is essential such that each of the spindle rows 35 effectively separate unique sized clumps of hair as the user rotates the rotary knob 55 (described herein below). Of course, the spindles 34 may be used for separating various kinds of stringed and threaded materials, as is obvious to a person of ordinary skill in the art.

Referring to FIGS. 1, 2, 3, 4 and 5, a mechanism 40 is included for selectively raising a selected group of the spindles 34 vertically upward and out from the casing 30. The spindle raising mechanism 40 includes a lever 41 confronting an outer side 36 of the casing 30 that is rotatable between vertical and horizontal positions. A first drive gear 42 is housed within the casing 30 and is directly connected, without the use of intervening elements, to the lever 41. Such a drive gear 42 has a toothed outer periphery 43. A first linear guide track 44 has a corrugated longitudinal surface 45 directly engaged, without the use of intervening elements, with the first drive gear 42, as is best shown in FIG. 4. Such a first guide track 44 contiguously lays along an interior wall 37 of the casing 30 and is oriented parallel to a vertical plane wherein the first guide track 44 is vertically displaced between raised and lowered positions when the first drive gear 42 is rotated during operating conditions.

Referring to FIGS. 1, 2, 3, 4 and 5, a mechanism 50 is included for horizontally registering the selected group of spindles 34 with the exit slot 31, which vital such that remaining ones of the spindles 34 are effectively prohibited from exiting through the exit slot 31, thereby automatically adjusting a thickness of the hair clumps that are separated by the selected spindles 34. The spindle registering mechanism 50 includes a platform 51 that is directly mated, without the use of intervening elements, to the first guide track 44. A second linear guide track 52 is registered orthogonal to the first linear track 44 and is housed within the casing 30, as is best shown in FIG. 5. A second drive gear 53 is directly inter-locked, without the use of intervening elements, with the second guide track 52. Such a second drive gear 53 has a shaft 54 directly connected thereto, without the use of intervening elements, that terminates to an exterior of the casing 30. A rotary knob 55 is directly connected, without the use of intervening elements, to the shaft 54 such that the second drive gear 53 can effectively be linearly displaced along a horizontal path of the second guide track 52, thereby horizontally aligning the selected spindles 34 beneath the slot 31. The first 42 and second 53 drive gears are independently and simultaneously operable. Such first 42 and second 53 drive gears have corresponding fulcrum axes registered parallel to each other.

In use, the person utilizing the device 10 quickly and easily secures the synthetic hair via the stabilizing clamp 32. Next, the hair strands are combed through, and the rotary knob 55 is adjusted to achieve a desired braid or weave thickness. The user activates the spindle raising mechanism 40 by rotating the lever 41, effectively causing the spindles 34 to separate the synthetic hair strands into the desired clumps and widths. By simultaneously braiding or weaving a plurality of hair clumps, the device 10 advantageously saves the user a considerable amount of time and energy.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A hairstyling device for assisting a user to separate clumps of hair for creating braids, said hairstyling device comprising:

a pair of telescopically adjustable legs seated on a support surface;

a casing directly coupled to said legs and supported at an elevated height, said casing having a linear exit slot extending along a longitudinal length thereof;

a plurality of spindles seated within said casing;

means for selectively raising a selected group of said spindles vertically upward and out from said casing; and means for horizontally registering said selected group of spindles with said exit slot such that remaining ones of said spindles are prohibited from exiting through said exit slot and thereby automatically adjusting a thickness of the hair clumps that are separated by said selected spindles.

2. The device of claim 1, wherein said spindle raising means comprises:

a lever confronting an outer side of said casing and being rotatable between vertical and horizontal positions;

a first drive gear housed within said casing and directly connected to said lever, said drive gear having a toothed outer periphery; and a first linear guide track having a corrugated longitudinal surface directly engaged with said first drive gear, said first guide track contiguously laying along an interior wall of said casing and being oriented parallel to a vertical plane wherein said first guide track is vertically displaced between raised and lowered positions when said first drive gear is rotated during operating conditions.

3. The device of claim 2, wherein said spindle registering means comprises:

a platform directly mated to said first guide track;

a second linear guide track registered orthogonal to said first linear track and housed within said casing;

a second drive gear directly inter-locked with said second guide track, said second drive gear having a shaft directly connected thereto and terminating exterior of said casing; and a rotary knob directly connected to said shaft such that said second drive gear can be linearly displaced along a horizontal path of said second guide track and thereby horizontally align said selected spindles beneath said slot.

4. The device of claim 3, wherein first and second drive gears are independently and simultaneously operable, wherein said first and second drive gears have corresponding fulcrum axes registered parallel to each other.

5. The device of claim 3, wherein said spindles are directly coupled to said second guide track.

6. The device of claim 5, wherein said spindles comprise:

first, second, third and fourth spindle rows registered parallel to each other and disposed within said casing, each of said spindle rows having a unique distance defined between adjacent spindles thereof such that each of said spindle rows separate unique sized clumps of hair as the user rotates said rotary knob.

7. A hairstyling device for assisting a user to separate clumps of hair for creating braids, said hairstyling device comprising:

a pair of telescopically adjustable legs seated on a support surface, wherein each of said telescopically adjustable legs comprises:

a linear female portion; and an inverted T-shaped male portion having a vertically registered top region slidable into said female portion, said male portion further having a horizontally registered bottom region directly coupled to said top region and directly engaging a support surface;

a casing directly coupled to said legs and supported at an elevated height, said casing having a linear exit slot extending along a longitudinal length thereof;

a plurality of spindles seated within said casing;

means for selectively raising a selected group of said spindles vertically upward and out from said casing; and means for horizontally registering said selected group of spindles with said exit slot such that remaining ones of said spindles are prohibited from exiting through said exit slot and thereby automatically adjusting a thickness of the hair clumps that are separated by said selected spindles.

8. The device of claim 7, wherein said spindle raising means comprises:

a lever confronting an outer side of said casing and being rotatable between vertical and horizontal positions;

a first drive gear housed within said casing and directly connected to said lever, said drive gear having a toothed outer periphery; and a first linear guide track having a corrugated longitudinal surface directly engaged with said first drive gear, said first guide track contiguously laying along an interior wall of said casing and being oriented parallel to a vertical plane wherein said first guide track is vertically displaced between raised and lowered positions when said first drive gear is rotated during operating conditions.

9. The device of claim 8, wherein said spindle registering means comprises;

a platform directly mated to said first guide track;

a second linear guide track registered orthogonal to said first linear track and housed within said casing;

a second drive gear directly inter-locked with said second guide track, said second drive gear having a shaft directly connected thereto and terminating exterior of said casing; and a rotary knob directly connected to said shaft such that said second drive gear can be linearly displaced along a horizontal path of said second guide track and thereby horizontally align said selected spindles beneath said slot.

10. The device of claim 9, wherein first and second drive gears are independently and simultaneously operable, wherein said first and second drive gears have corresponding fulcrum axes registered parallel to each other.

11. The device of claim 9, wherein said spindles are directly coupled to said second guide track.

12. The device of claim 11, wherein said spindles comprise, first, second, third and fourth spindle rows registered parallel to each other and disposed within said casing, each of said spindle rows having a unique distance defined between adjacent spindles thereof such that each of said spindle rows separate unique sized clumps of hair as the user rotates said rotary knob.

13. A hairstyling device for assisting a user to separate clumps of hair for creating braids, said hairstyling device comprising:

a pair of telescopically adjustable legs seated on a support surface, wherein each of said telescopically adjustable legs comprises:

a linear female portion; and an inverted T-shaped male portion having a vertically registered top region slidable into said female portion, said male portion further having a horizontally registered bottom region directly coupled to said top region and directly engaging a support surface;

a casing directly coupled to said legs and supported at an elevated height, said casing having a linear exit slot extending along a longitudinal length thereof, a stabilizing clamp pivotally connected to an exterior of said casing, said stabilizing clamp extending along an entire longitudinal length of said casing and being provided with a fastening clip oppositely seated from a pivot axis thereof, said stabilizing clamp and said slot having corresponding longitudinal lengths extending parallel to each other;

a plurality of spindles seated within said casing;

means for selectively raising a selected group of said spindles vertically upward and out from said casing; and means for horizontally registering said selected group of spindles with said exit slot such that remaining ones of said spindles are prohibited from exiting through said exit slot and thereby automatically adjusting a thickness of the hair clumps that are separated by said selected spindles.

14. The device of claim 13, wherein said spindle raising means comprises:

a lever confronting an outer side of said casing and being rotatable between vertical and horizontal positions;

a first drive gear housed within said casing and directly connected to said lever, said drive gear having a toothed outer periphery; and a first linear guide track having a corrugated longitudinal surface directly engaged with said first drive gear, said first guide track contiguously laying along an interior wall of said casing and being oriented parallel to a vertical plane wherein said first guide track is vertically displaced between raised and lowered positions when said first drive gear is rotated during operating conditions.

15. The device of claim 14, wherein said spindle registering means comprises:

a platform directly mated to said first guide track;

a second linear guide track registered orthogonal to said first linear track and housed within said casing;

a second drive gear directly inter-locked with said second guide track, said second drive gear having a shaft directly connected thereto and terminating exterior of said casing; and a rotary knob directly connected to said shaft such that said second drive gear can be linearly displaced along a horizontal path of said second guide track and thereby horizontally align said selected spindles beneath said slot.

16. The device of claim 15, wherein first and second drive gears are independently and simultaneously operable, wherein said first and second drive gears have corresponding fulcrum axes registered parallel to each other.

17. The device of claim 15, wherein said spindles are directly coupled to said second guide track.

18. The device of claim 17, wherein said spindles comprise:

first, second, third and fourth spindle rows registered parallel to each other and disposed within said casing, each of said spindle rows having a unique distance defined between adjacent spindles thereof such that each of said spindle rows separate unique sized clumps of hair as the user rotates said rotary knob.

* * * * *